US009392830B2

(12) United States Patent
Simmons, Sr.

(10) Patent No.: US 9,392,830 B2
(45) Date of Patent: Jul. 19, 2016

(54) APPAREL WITH SAFETY HANDLES

(71) Applicant: David Elmore Simmons, Sr., Charleston, SC (US)

(72) Inventor: David Elmore Simmons, Sr., Charleston, SC (US)

( * ) Notice: Subject to any disclaimer, the term of this patent is extended or adjusted under 35 U.S.C. 154(b) by 164 days.

(21) Appl. No.: 14/157,848

(22) Filed: Jan. 17, 2014

(65) Prior Publication Data

US 2015/0201678 A1 Jul. 23, 2015

(51) Int. Cl.
*A41D 3/00* (2006.01)
*A41F 9/00* (2006.01)

(52) U.S. Cl.
CPC . *A41F 9/005* (2013.01); *A41D 3/00* (2013.01); *A41D 2600/102* (2013.01)

(58) Field of Classification Search
CPC ..... A41D 2600/102; A41F 9/005
USPC ..... 2/311, 312, 318, 319, 338; 182/3; 280/290; 224/195, 914
See application file for complete search history.

(56) References Cited

U.S. PATENT DOCUMENTS

| | | | | |
|---|---|---|---|---|
| D116,885 | S | 9/1939 | Nieberg | |
| 4,028,742 | A * | 6/1977 | Marquis | 2/305 |
| 5,081,719 | A * | 1/1992 | Donnelly | 2/311 |
| 5,152,013 | A * | 10/1992 | Johnson | 2/321 |
| 5,881,933 | A * | 3/1999 | Rogers | 224/195 |
| D500,393 | S * | 12/2004 | Beacham et al. | D29/100 |
| 7,114,196 | B1 * | 10/2006 | Cicio | 2/338 |
| D627,541 | S | 11/2010 | Simmons | |
| 2010/0320241 | A1 | 12/2010 | Thompson | |
| 2012/0174298 | A1 | 7/2012 | Bay | |
| 2013/0047314 | A1 | 2/2013 | Alvarado, Jr. | |

FOREIGN PATENT DOCUMENTS

EP 1925223 A 5/2008

* cited by examiner

*Primary Examiner* — Katherine Moran
(74) *Attorney, Agent, or Firm* — The Law Firm of Andrea Hence Evans, LLC

(57) ABSTRACT

The invention features apparel having a safety assembly featuring adjustable handles. The handles move along tracks and can be positioned to be grasped by a passenger on a vehicle. A latch mechanism unlocks the handles and allows them to move along the tracks. Handles feature a catch mechanism that locks into an opening along the track helping to secure the handles in position. When a vehicle operator wears the apparel, the passenger can grasp the handles to position himself accordingly and safely on a vehicle, such as a motorcycle.

5 Claims, 4 Drawing Sheets

APPAREL WITH SAFETY HANDLES

FIELD OF THE INVENTION

The present invention relates, in general, to apparel having safety handles, and more specifically, adjustable handles which can be grasped by a passenger on a motorcycle.

BACKGROUND OF THE INVENTION

Apparel is used to protect motorcyclist from the elements. During rides, apparel, such as jackets or vests, are often worn by motorcyclist to preserve the motorcyclist's core's body heat. In extreme weather conditions, apparel protects the cyclist's body. Apparel also allows the cyclist to stay at a safe body temperature and be protected from bugs and debris during a ride. In the event of an accident, abrasion resistant apparel helps prevent injuries with its padding and lining such as armor mounted in the jacket.

Often individuals ride motorcycles as passengers. Passengers can make a long ride more enjoyable for the motorcyclist. The passenger can wear a helmet and a jacket as a safety precaution. It is necessary for the passenger to keep his body aligned with the motorcyclist's body to prevent an accident. Typically, the passenger places his hands around the motorcyclist's hips. In the event of a sharp turn or sudden stop, passengers tend to panic and add pressure by squeezing the cyclist's hips. This pressure can distract the motorcyclist. Unnecessary movement of the passenger affects movement and balance of the motorcycle and can put both the motorcyclist and passenger in danger.

SUMMARY OF THE INVENTION

The present invention provides apparel with a safety assembly having adjustable handles that allow a passenger to grasp while on a motorcycle or other vehicle needing increased stability of the passenger.

An aspect of an embodiment of the invention provides handles on apparel that allow the passenger to be in touch with the operator's movements without directly touching the operator's body.

A limber aspect of an embodiment of the invention features tracks which the handles slide along to the passenger's desired location for gripping.

A further aspect of an embodiment of the invention features openings along the safety assembly that help to lock the handle in position.

A further aspect of the invention features a latch system which releases the handle from its opening to allow movement of the handles.

Additional aspects, objectives, features and advantages of the present invention will become apparent from the following description of the preferred embodiments with reference to the attached drawings.

DETAILED DESCRIPTION OF THE INVENTION

Figure 1:
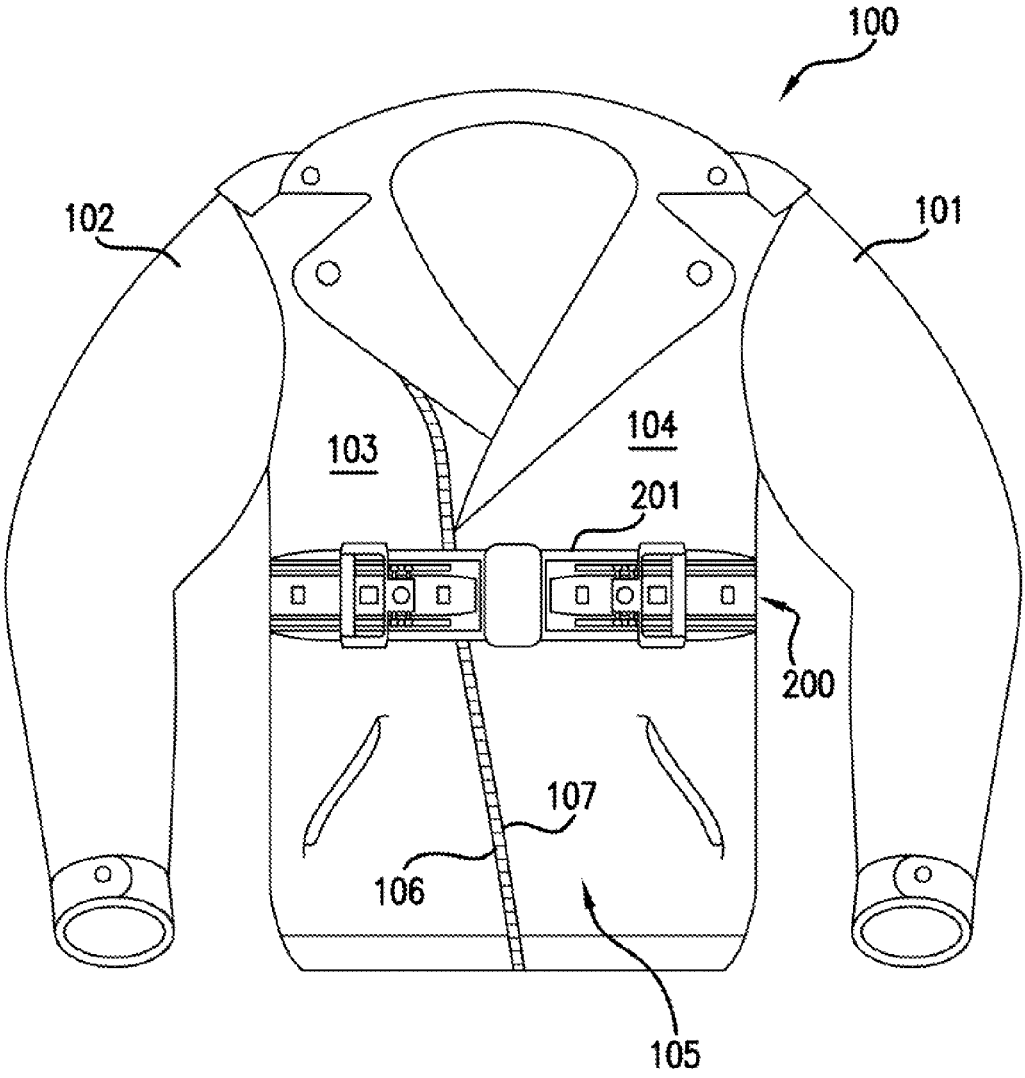
FIG. 1 is a front perspective view of apparel with the safety assembly.

FIG. 1 is a front perspective view of apparel 100 with the safety assembly 200. The apparel 100 is preferably a motorcycle jacket. The sleeves 101, 102 of the jacket 100 may be removed to convert the jacket 100 into a vest. Preferably, the apparel is clothing adapted to be worn by a driver of a motorcycle. The jacket 100 features a front left side panel 103 and a front right side panel 104 together forming a front panel 105. For illustration and discussion purposes, the jacket is divided into right and left panels; however, the panels may be formed of one sheet of material. The front left side panel 103 is the material on the front left side of the jacket and the front right side panel 104 is the material on the front right side of the jacket. Sleeves 101, 102 extend from an upper area of the front left panel 103 and the front right panel 104, respectively. The sleeves are positioned such that the wearer's arms can extend through the sleeves when the jacket is worn. If the sleeves are removed, or the apparel is in the form of a vest, the user's arms would extend through openings at the upper area of the panels.

Figure 2:
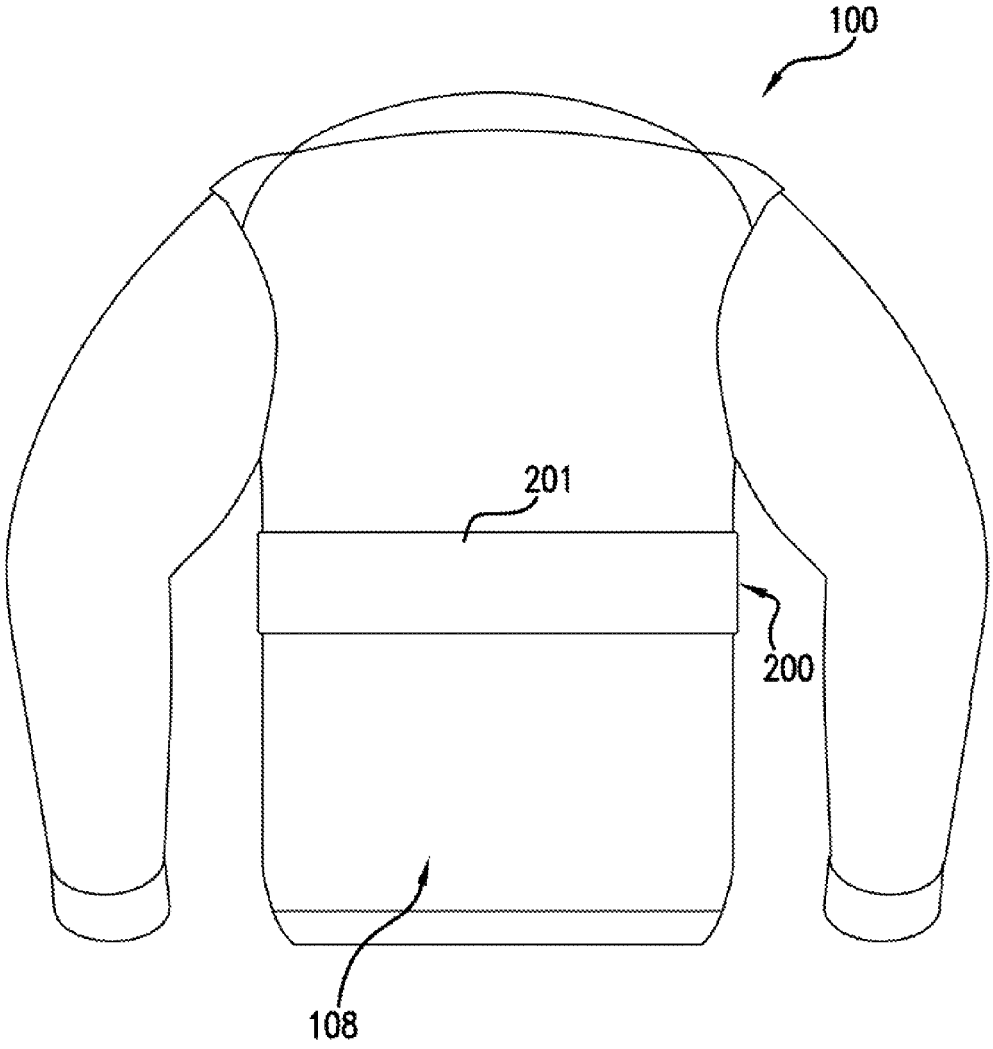
FIG. 2 is a back perspective view of the apparel with the safety assembly.

The front left side panel 103 and front right side panel 104 feature left side panel edges 106 and right side panel edges 107. The edges 106, 107 contact and connect to each other to close the jacket using known connection mechanisms such as snaps, buttons, zippers and the like. When the edges 106, 107 are not in a connected position, as shown in FIG. 1, there is an opening between the front left side panel and front right side panel such that the jacket will be in an open position. FIG. 2 is a back perspective view of the apparel 100 with the safety assembly 200. A back panel 108 forms the back side of the jacket. As discussed above, the back panel 108 and left front panel 103 and right front panel 104 may be one continuous sheet of material or multiple sheets of material stitched together to form the apparel.

Figure 3:
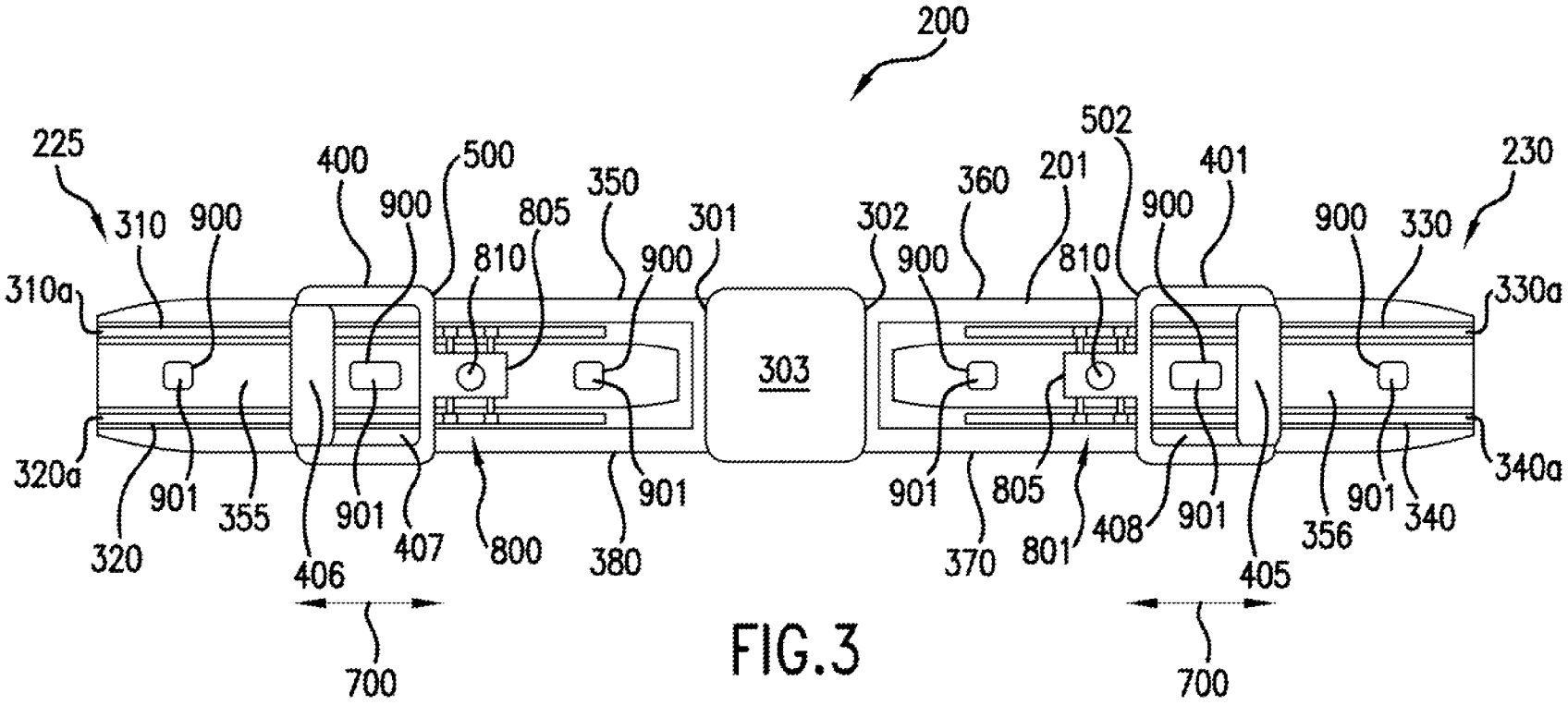
FIG. 3 is a perspective view of the safety assembly.

FIG. 3 is a perspective view of the safety assembly 200. The safety assembly 200 features a band 201 which extends from the left side panel 103 around the back panel 108 and to the right side panel 104. The band 201 is affixed permanently to the apparel in the middle area of the jacket, as shown in FIGS. 1 and 2. With the band in the middle area of the jacket, the passenger can grip the safety assembly and not throw off the balance of the driver. However, the band may be affixed to the lower waist area of the jacket to allow passengers to grip the safety assembly with their arms and hands in a downward position. The jacket supports the band and aids in minimizing the risk of the band being inadvertently removed from the apparel when used by a passenger.

The left end 301 of the band 201 can be connected to the right end 302 of the band 201 to engage and close the band with a securing mechanism. A securing mechanism, such as a buckle 303, may be connected to the right end 302 and 30 secured to the left end 301. The band features a left band side 225 and a right band side 230, which coincide with the left front panel 103 and right front panel 104, respectively. Preferably, in a fully closed position, the left and right edges 106, 107 are engaged and the left and right ends 301, 302 of the band are engaged.

The band features a left plate 355 and a right plate 356. The plates 355 and 356 are secured to the left and right band sides 225, 230 respectively, on the top surface of the band. A first pair of tracks 310, 320 on the left band side 225 and a second pair of tracks 330, 340 on the right band side 230. The left side 225 of the band and the right side 230 of the band are flipped variations of each other and they are symmetrical along the x-axis. Tracks 310 and 320 are parallel to each other. Tracks 330 and 340 are parallel to each other. Track 310 is disposed along a top edge 350 on the left plate 355 on the band. Track 330, on the right side 230, is aligned with track 310. Track 330 is disposed along a top edge 360 on the right plate 356 on the band. Similarly, tracks 320 and 340 are aligned. Track 340 is disposed along a bottom edge 370 on the right plate 356 on the band. Track 320 is disposed along a bottom edge 380 on the left plate 355 on the band. The tracks are aligned to keep the first and second handles 400, 401 in their proper position. The first and second handles 400, 401 move in a left and right direction shown by arrows 700 along the tracks.

The first and second handles feature a cover 405, 406 which allows the passenger to easily grip the handles and the cover helps to prevent their hands from slipping.

The handles are a square shape but may be an alternate shape so long as the user can position their fingers through the handle openings 407, 408. The inside of the square shaped handle is cut-out or open to receive the hands and fingers of the passenger. The handles are parallel to the top surface of the band along the z-axis and the handles lay somewhat flat. The handles are about a quarter of an inch above the band, which allows the passengers hands to fit through the openings and grasp the handle where their fingers are in a curled position around the handle.

The first and second handles 400, 401 move along the tracks for proper positioning of the handles on the band 201. The handles 400, 401 features slide members 600, 601, 602, and 603, shown in FIG. 5, which are received by the tracks and move along the tracks in the direction shown by 407. The tracks feature grooves 310*a*, 320*a*, 330*a*, 340*a*. The slide members 600, 601, 602 and 603 are pins with ends that move along the grooves in the direction shown by 700. Alternatively, the slide members may be increased or decreased so long as the members move the handles along the tracks.

Figure 5:
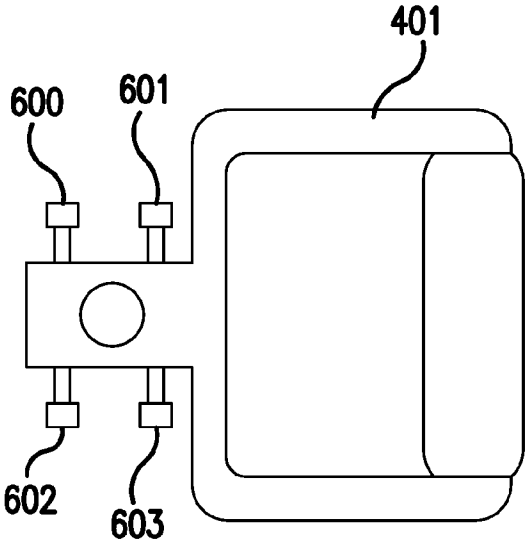
FIG. 5 is an illustration of the pins which move along the track of the safety assembly.

FIG. 5 is an illustration of the pins 600, 601, 602 and 603 which move along the track of the safety assembly. For discussion purposes, handle 401 is shown and discussed; however, handle 400 features identical elements of handle 401.

The handle 401 and connected pins 600, 601, 602 and 603 lay above and on the top surface of plate 356. The handles 400, 401 are designed to lay flat against the plate so they are not hanging or moving unnecessarily. They are positioned so that the passenger's fingers can grasp the handle with little distraction to the driver. The handles are parallel to the top surface of the band.

Figure 4:
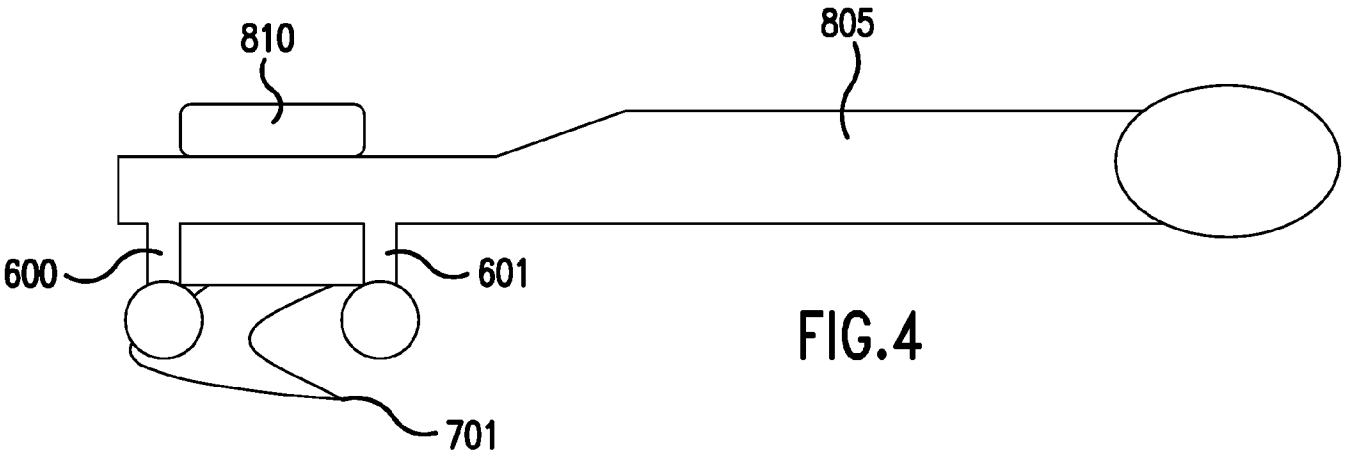
FIG. 4 is an illustration of the latch mechanism of the safety assembly.

The front side 500 of the first handle 400 features a latch mechanism 800. The front side 502 of the second handle 401 features an identical latch mechanism 801. For discussion purposes, the latch mechanism is discussed in relation to handle 400. FIG. 4 is an illustration of the latch mechanism 800, 801 of the safety assembly. The latch mechanism 800 is a bracket 805 or plate connected to the front side 500 of handle 400. The pins 600, 601, 602 and 603 are secured to the underside of the bracket and extend outward towards the tracks on the plate member. Roller members on the ends of each pin allow the pins to move along the track's grooves, as discussed above. The plates 355, 356 feature openings 900 incrementally spaced along the top surface of the plates 355, 356. The band features band openings 901 aligned underneath the plate openings 900. The plate openings 900 help to prevent the band openings 901 from unnecessarily stretching or tearing during use. The openings 900, 901 are sized to receive a catch mechanism 700 on the handles' latch mechanism which locks the handles in position. The latch mechanisms 800, 801 feature a button 810 which release and lock the catch mechanism 700 in its desired position, the openings 900, 901. As the handle assembly moves along the plate, when the button 810 is pushed in a downward direction, the catch mechanism is moved downward and the hook on the catch mechanism locks the handle in the user's desired position. The hook is underneath the handles and catches such that it prevents the handle from moving out of position. The button is a push button and the hook is spring loaded to allow upwards and downwards movement. The slide and hook movement allows the hook to fit and hook inside of the openings. The handle assembly of the present invention allows for adjustment of the handles along the front of the apparel. However, the invention may be modified to extend the tracks around the back of the apparel, if desired. Furthermore, the tracks may be shortened or elongated, so long as the passenger can grasp the handles and have a sense of stability on the motorcycle.

The invention has been described in detail with particular reference to certain preferred embodiments thereof, but it will be understood that variations and modifications can be effected within the spirit and scope of the invention.

The invention claimed is:

1. Apparel comprising:

A front left side panel and a front right side panel forming a front panel;

A back panel;

A safety assembly featuring a band extending from the left side panel around the back panel and to the right side panel, tracks on the band, A first handle and a second handle are adapted to be supported by the band, wherein the first and second handle move along the tracks for proper positioning of the handles, wherein catch mechanisms are positioned on a lower surface of the handles and the band comprises band openings sized to receive said catch mechanisms which locks the handles in position, wherein a plate comprises plate openings sized to receive the catch mechanisms on the handles which locks the handles in position, and wherein the plate openings are aligned with the band openings, wherein latch mechanisms are positioned on an upper surface of the handles, said latch mechanisms being adapted to release and lock the catch mechanisms in their desired positions.

2. The apparel of claim 1, wherein the band further comprises securing mechanisms on ends of the band which connect a left band end with a right band end to move the band to a closed position.

3. The apparel of claim 1, wherein the tracks are on a top and bottom edge of a plate which is positioned on an outer surface of the band.

4. The apparel of claim 1, wherein slide members adapted to be received by and move along the tracks are positioned on the handles.

5. The apparel of claim 1, wherein the handles are parallel to the top surface of the band.

* * * * *